United States Patent [19]

Sweeney

[11] 3,990,524

[45] Nov. 9, 1976

[54] DOWN-THE-HOLE MOTOR FOR ROTARY DRILL ROD AND PROCESS FOR DRILLING USING THE SAME

[75] Inventor: Gerald T. Sweeney, Federal Way, Wash.

[73] Assignee: Tigre Tierra, Inc., Puyallup, Wash.

[22] Filed: May 7, 1975

[21] Appl. No.: 575,429

Related U.S. Application Data

[60] Continuation of Ser. No. 475,594, June 3, 1974, Pat. No. 3,903,975, which is a division of Ser. No. 283,208, Aug. 23, 1972, Pat. No. 3,854,539.

[52] U.S. Cl. ..... 175/246; 173/78

[51] Int. Cl.[2] ..... E21B 1/00

[58] Field of Search ..... 175/58, 92, 105, 236, 175/246, 248, 257, 296, 389, 390; 173/15, 71, 72, 73, 78, 80, 91, 92, 119, 132

[56] References Cited

UNITED STATES PATENTS

| | | | |
|---|---|---|---|
| 1,005,770 | 10/1911 | Clark | 173/78 |
| 1,717,271 | 6/1929 | Simmons | 175/105 |
| 2,138,006 | 11/1938 | Howard | 175/248 |
| 2,345,739 | 4/1944 | Fisher | 175/257 |
| 2,947,519 | 8/1960 | Feucht | 173/80 |
| 3,154,153 | 10/1964 | Wilder et al. | 173/80 |
| 3,524,511 | 8/1970 | Klemm | 173/78 |
| 3,635,295 | 1/1972 | Cobbs | 175/257 |
| 3,682,260 | 8/1972 | Klemm | 175/257 |

*Primary Examiner*—James A. Leppink
*Attorney, Agent, or Firm*—Christopher Duffy

[57] ABSTRACT

The motor is adapted to be used to drive a rotary drill rod of the type comprising an elongated pipe having a longitudinally extending bore therethrough, a percussive bit at the distal end thereof, and an abutment thereon relatively transverse the bore adjacent the bit. The motor comprises a cylindrically outlined piston member which is adapted to be slidably engaged in the bore of the pipe and has a fluid operated hammer mechanism thereon for applying hammer blows to the rod through the abutment. It also comprises an anvil member which is coaxially interconnected with the piston member at a position relatively forwardly of the hammer mechanism and has a diameter no greater than that of the piston member so that it can be inserted in the bore ahead of the piston member and engaged with the abutment to receive and transmit the hammer blows into the abutment. In addition, the motor comprises fluid transmission means for operating the hammer mechanism, means on the relatively rear end portion of the piston member for admitting fluid to the same from the bore of the pipe when the motor is engaged in the bore, and means for discharging the fluid from the motor including means for passing fluid through the anvil member from the piston member. The motor also includes means on the piston member for causing a pressure drop in the fluid as it discharges from the motor, whereby a pressure differential can be generated across the motor axially of the members when the motor is engaged with the abutment and transmitting hammer blows thereto.

18 Claims, 5 Drawing Figures

DOWN-THE-HOLE MOTOR FOR ROTARY DRILL ROD AND PROCESS FOR DRILLING USING THE SAME

This is a continuation of application Ser. No. 475,594, filed June 3, 1974, now U.S. Pat. No. 3,903,975, which is a division of Ser. No. 283,208, filed Aug. 23, 1972, now U.S. Pat. No. 3,854,539.

THE INVENTION IN GENERAL

According to the invention, the motor is adapted to be used to drive a rotary drill rod of the type comprising an elongated pipe having a longitudinally extending bore therethrough, a percussive bit at the distal end thereof, and an abutment thereon relatively transverse the bore adjacent the bit. The motor comprises a cylindrically outlined piston member which is adapted to be slidably engaged in the bore of the pipe and has a fluid operated hammer mechanism thereon for applying hammer blows to the rod through the abutment. It also comprises an anvil which is coaxially interconnected with the piston member at a position relatively forwardly of the hammer mechanism and has a diameter no greater than that of the piston member so that it can be inserted in the bore ahead of the piston member and engaged with the abutment to receive and transmit the hammer blows into the abutment. In addition, the motor comprises fluid transmission means for operating the hammmer mechanism, means on the relatively rear end portion of the piston member for admitting fluid to the same from the bore of the pipe when the motor is engaged in the bore, and means for discharging the fluid from the motor including means for passing fluid through the anvil member from the piston member. The motor also includes means on the piston member for causing a pressure drop in the fluid as it discharges from the motor, whereby a pressure differential can be generated across the motor axially of the members when the motor is engaged with the abutment and transmitting hammer blows thereto.

The anvil member may be cylindrically outlined and have the same diameter as the piston member so that it is also adapted to be slidably engaged in the bore of the pipe. Also, the piston member may be adapted so that the fluid admitted to the relatively rear end portion of the same, operates the hammer mechanism and then exhausts from the mechanism through the anvil member.

Where the rod is of a type in which the abutment opens into the working face of the bit, the motor may further comprise an excavation member which is coaxially interconnected with the anvil member and has a diameter less than that of the anvil member so that it is adapted to insert into the opening of the abutment when the anvil member is engaged with the abutment. The anvil and excavation members may be relatively reciprocably interconnected with one another; and in fact may be relatively rotatably and reciprocably interconnected with one another. Also, the anvil member may have a fluid passage therein, and a port for discharging the fluid from the passage about the excavation member.

The anvil and excavation members may be detachably interconnected with one another.

The excavation member may take the form of a core barrel.

The piston and anvil members also may be relatively reciprocably interconnected with one another.

The motor may further comprise attachment means on the relatively rear end portion of the piston member for releasable engagement by a wire line retriever or the like.

In the process of drilling of an earth formation using the aforedescribed drill rod, an anvil member is inserted into the bore of the pipe and the member is engaged with the abutment. A cylindrically outlined piston member is inserted into the bore at a position relatively rearwardly of the anvil member, and the piston member is slidably engagable with the bore and has a fluid operated hammer mechanism thereon, the hammer of which is relatively reciprocable between the anvil and piston members. Blows are applied to the anvil member with the hammer mechanism, to drive the rod, while the rod is rotated and the bore of the pipe is charged with pressurized fluid relatively rearwardly of the piston member. Fluid is admitted to the piston member from the bore, and is discharged from the motor through the anvil member. A pressure drop is caused in the fluid as it discharges from the motor, to generate a pressure differential across the motor longitudinally of the bore.

The hammer mechanism may be operated by the fluid admitted to the piston member, and the operating fluid may be exhausted through the anvil member after the mechanism has operated.

BRIEF DESCRIPTION OF THE DRAWINGS

These features will be better understood by reference to the accompanying drawings wherein.

DESCRIPTION OF THE PREFERRED EMBODIMENT

Figure 1:
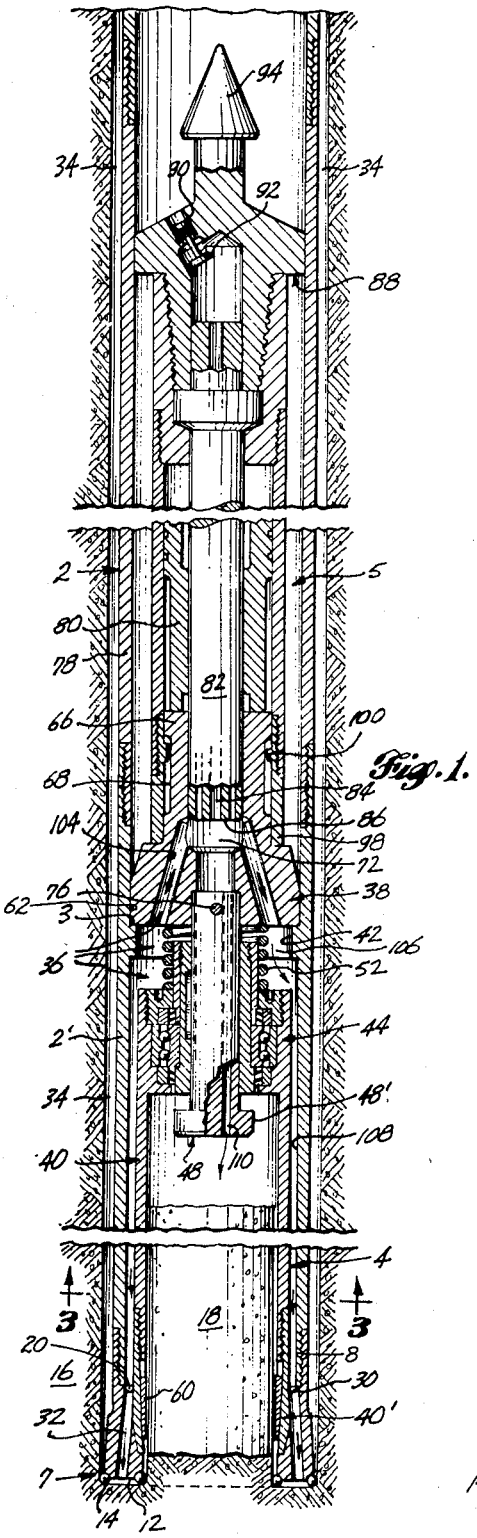
FIG. 1 is a part longitudinal cross-sectional view of one of my presently preferred embodiments of the invention, as it is seen in use for a down-the-hole core drilling operation, and with the hammer mechanism in the bottomed condition thereof.
Figure 2:
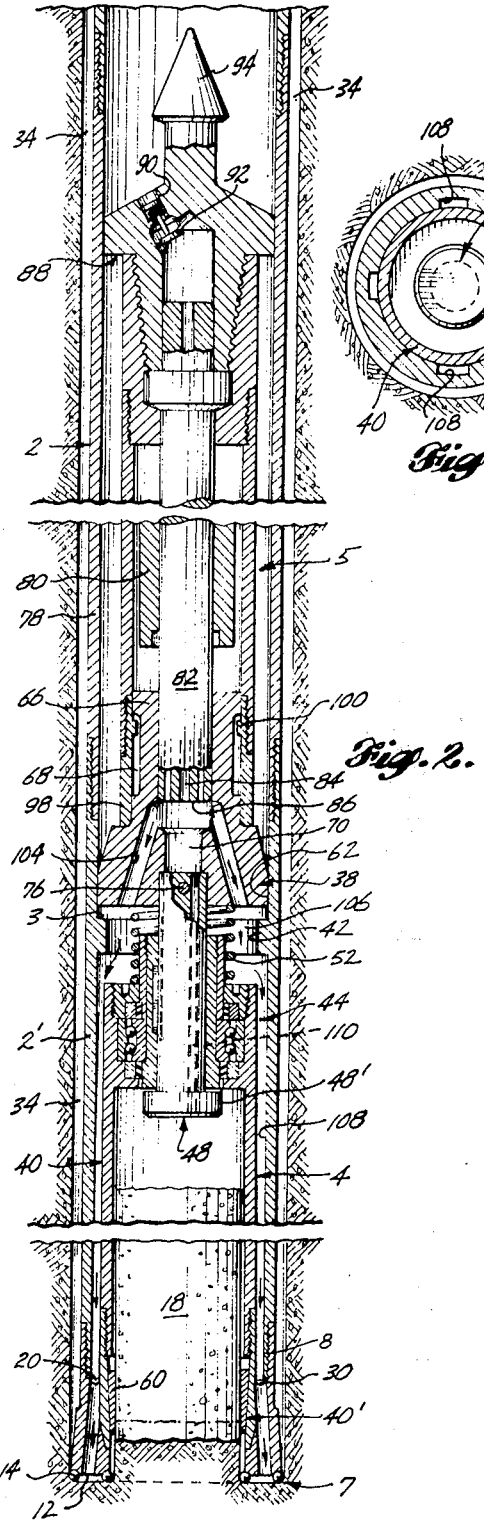
FIG. 2 is another such view as the hammer mechanism is in the upstroke thereof.
Figure 3:
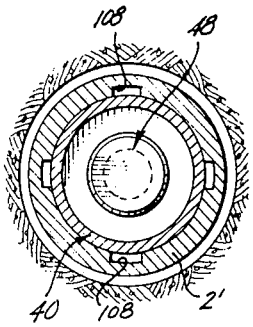
FIG. 3 is a transverse cross-sectional view along the line 3—3 of FIG. 1.
Figure 4:
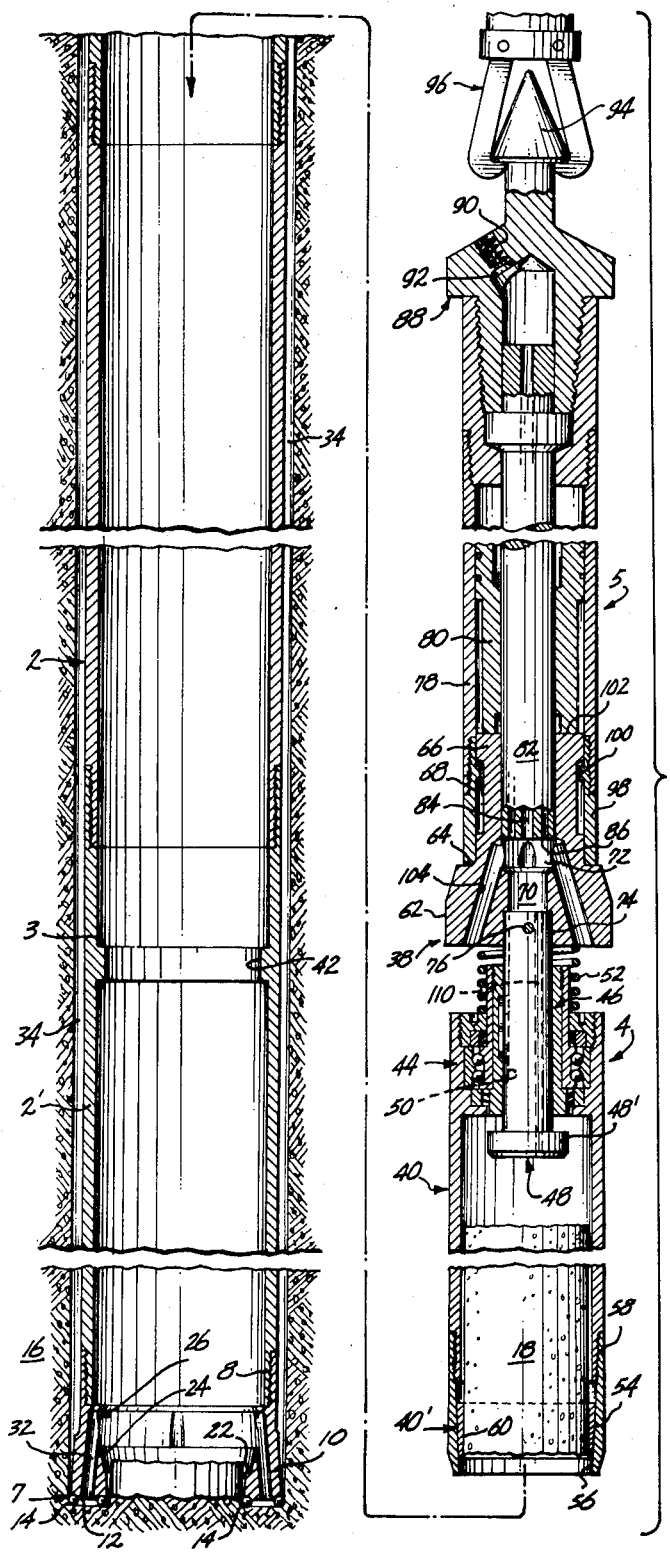
FIG. 4 is another part longitudinal cross-sectional view when the motor has been retracted from the drill rod.

Referring to the drawings, it will be seen that the drill rod comprises, an elongated, fluid pressurized pipe 2, which is assembled from equal-diameter sections that are perhaps 10' in length and threaded and flush-coupled to one another as illustrated. With the exception of the interior of the bottommost or distal end section 2' of the pipe, the sections are otherwise similar to one another, and are added to and subtracted from the pipe as is necessary during the drilling operation. The distal end section 2' differs, however, in that it has a stepped or counterbored interior configuration which forms an inner peripheral shoulder 3 at a point near the top thereof. The shoulder serves as an abutment for the motor 4, which is retractable from the rod, as shall be explained; and which includes a standard, fluid-operated down-the-hole hammer mechanism 5.

The pipe is pressurized and driven by a conventional drilling mechanism, such as that shown in U.S. Pat. No.

Figure 5:
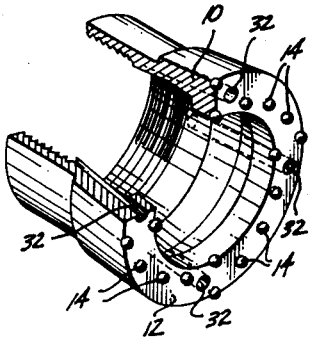
FIG. 5 is a part perspective view of the bit employed in the drill rod.

3,391,543, and is typically driven at slow speeds such as 10 RPM, that is, at speeds simply sufficient to index the percussion bit 7 at the bottom or distal end of the pipe. The bit 7 is annular in configuration, and has an interiorly threaded collar 8 at the upper end thereof, that flush-couples to the distal end section 2' of the pipe. Below the collar, however, the bit is flared radially outwardly and forms an enlarged head 10 which terminates with a flatfaced annulus 12 at the working end thereof. The annulus has sets of button-like percussion points 14 seated in raised condition thereon, which are spaced apart in angularly spaced, clockwise, convolutional lines that are symmetrically arranged about the axis of the bit. See FIG. 5. In addition, the endmost points 14 on each line, are seated in the head so as to project slightly inside and outside of the inner and outer peripheries of the annulus, respectively. As a consequence, when the rod is rotated and hammered into an earth formation 16, the bit excavates an annular recess the outside diameter of which is not only greater than the outside diameter of the pipe itself, but also greater than the outside diameter of the flared head 10 of the bit. Likewise, the core 18 of earth material which is captured within the end of the rod, has an outside diameter of slightly lesser dimension than the inside diameter of the head of the bit.

Otherwise, the bit has a stepped or counterbored interior configuration forming an annular shoulder 20 inside of and about the bottom end of the collar 8. The interior of the bit also has another annular shoulder 22 therebelow, which is of lesser inside and outside dimensions than the shoulder 20, by virtue of there being an inwardly chamfered surface 24 at the bottom of the cylindrical socket 26 separating the two shoulders. The lower shoulder 22 and the socket 26 form a seat for a core barreling tube 40 on the motor, as shall be explained; whereas the upper shoulder 20 has an annular groove 30 recessed therein, from which a series of symmetrically angularly spaced ports 32 open through the body of the head 10 to the working face 12 of the bit, between the points 14 thereon. The ports are also canted to the axis of the head, and are so angled into the shoulder that they open into the socket 26.

During the drilling operation, the compressed fluid is intermittently discharged to the ports 32 to flush the removed earth material back through the clearance 34 between the pipe 2 and the wall of the excavation. The fluid reaches the ports through a series of passages 36 which are formed within the motor and the distal end section 2' of the pipe, as shall be explained more fully hereinafter.

The motor 4 also includes an annular anvil 38 which is slidably engageable in the upper, thinner walled portion of the distal end section 2', and sized to seat on the shoulder 3. The core barreling tube 40 is slidably engageable in the bore 42 of the lower, thicker walled portion of the section 2', and suspended from the anvil to seat relatively rotatably within the socket 26 of the bit. The tube is equipped with a bushed, ball bearing mounted swivel head 44 on the upper end thereof, and the bushing 46 of the head is slidably engaged on, but rotationally keyed to a flanged swivel pin 48, which is fastened upright to the underside of the anvil. Moreover, the keyway 50 for the bushing, and the length of the bushing, are sized in relation to the pin, to allow for play between the tube and the anvil, axially thereof; and a coiled spring 52 is interposed about the bushing 46, between the head and the underside of the anvil, to bias the tube in the downward direction, toward the flange 48' of the pin. Thus, when the motor 4 is lowered into the bore of the pipe 2, the tube 40 is urged to seat within the bit, both by the spring 52 and by the force of gravity; yet it is also free to undergo displacement in relation to the anvil, where there is earth material lodged within the bit. The earth material may be dislodged, however, either by the anvil, or by the fluid discharge, or by both, as shall be explained hereinafter.

In addition to being adapted to mate with the bit, the forward end portion 40' of the tube 40 is also adapted to "lift" or separate the core 18 from the earth formation when the motor 4 is retracted from the bore of the pipe. The tube 40 is formed in two threaded and flushed-coupled parts, the more forward 40' of which is chamfered at the end, so as to mate with the chamfered socket 26 of the bit, and form an essentially air tight joint therebetween. The more forward portion 40' also has an upwardly and outwardly tapered surface 54 formed between the cyclindrical mouth 56 and the threaded collar 58 of the same; and when the two parts of the tube are assembled, a tapered wedge-like annular core lifter 60 is inserted within the more forward portion, to perform the core lifting and separating function in conventional fashion.

The outer cylindrical surface 62 of the anvil is closely machined to form a fluid seal with the bore of the pipe. Above the surface, however, the anvil is swaged inwardly and provided with a filleted shoulder 6 thereabout, from which a nipple-like shank or embossment 66 is upstanding on the axis of the anvil, and equipped with a wide circumferential groove 68 thereabout. The bore 70 of the anvil is counterbored from above and below, and the upper counterbore 72 of the same is adapted to interengage with the hammer mechanism, as shall be explained, whereas the lower counterbore 74 provides a socket for the swivel pin 48, which is secured in the socket by means of a dowel 76.

The hammer mechanism 5 is a modified version of a standard down-the-hole air hammer mechanism, comprising an outer tubular casing 78 having a pipe hammer 80 reciprocably engaged about a stationary control rod 82 therein. The control rod 82 is ported and infrastructured to enable the compressed fluid to reciprocate the hammer in known manner, and alternatively to exhaust through porting 84 in the distal end 86 of the control rod. The fluid enters the control rod through a port or ports 90 in a spear-headed, piston-like cap 88 which is threaded onto the upper end of the casing and adapted to slidably engage with the wall of the bore of the pipe 2, as illustrated. The ports 90 are equipped with spring-loaded throttle valves 92 that operate to produce a pressure drop between the upper and lower sides of the motor, so that the fluid can assist in seating the anvil on the shoulder 3 of the pipe.

The anvil is coupled to the hammer mechanism by telescopically engaging a threaded, two-part, inner ribbed collar 98 about the embossment 66 of the anvil 38, and flush-coupling the collar to the distal end of the casing 78, the inner circumferential rib 100 of the collar, meanwhile interengaging in the groove 68 of the embossment. The motor is retracted from the rod by an overhead hoist, such as a standard wire-line retriever, the dogs 96 of which are engaged about the spearhead 94 of the cap.

During the drilling operation, the hammer 80 interfaces with the annulus 102 at the upper end of the anvil, and applies intermittent blows to the anvil, as the pipe 2 is rotated thereabout. Thus, the bit is continually advanced in the axial direction by the percussive effect of the hammer, and at the same time, is continually rotated by the pipe, so that the points 14 of the bit are reindexed with respect to the face of the excavation, each time that the hammer strikes. Moreover, due to the telescoping relationship between the tube 40 and the pipe, and the relatively reciprocable, swiveled relationship between the tube and the anvil, the tube remains substantially stationary with respect to the pipe, as the pipe is rotated and advanced into the formation.

During the drilling operation, moreover, the exhaust porting 84 in the control rod is placed in communication with the passages 36, so as to exhaust the fluid about the bit. As seen, the distal end portion 86 of the control rod is slidably inserted in the bore 72 of the anvil; and in the bore, there is a series of symmetrically angularly spaced and outwardly slanted ports 104, which open to the underside of the anvil, opposite the chamber 106 which is formed between the head 44 of the tube and the anvil. From there, the fluid enters a series of symmetrically angularly spaced flutes 108 in the bore 42 of the pipe, which commence below the level of the shoulder 3, and terminate in the distal end of the pipe, to communicate with the groove 30 and the ports 32 in the bit. In the engaged and socketed condition of the tube 40, the open sides of the flutes are closed by the main body of the tube, and the socket 26 is occupied by the forward portion 40′ thereof, so that the fluid can escape only through the ports 32. Until the tube is socketed in the bit, however, a portion of the fluid will discharge through the axial opening of the bit, so as to assist in flushing out any accumulated debris which would otherwise prevent the tube from seating in the socket of the bit.

Moreover, in such a case, the spring 52 will be compressed by the tube to the point where the bushing 46 of the swivel head engages the face of the anvil; and thereafter, when the hammer 80 is applied to the anvil, the force of the hammer will operate on the tube only, until the anvil re-engages the shoulder 3 of the pipe. Thus the operator can be assured that the tube will be properly seated before the drilling operation is begun.

In the seating process, moreover, a passage 110 through the pin 48, assures that the tube 40 is also pressurized, so that the debris can move in the direction outward through the clearance 34.

Of course, as drilling progresses, more and more sections are added to the drill pipe 2. If necessary or desired, the tube can be changed at the same time to account for wear of the inner points of the bit; or the bit can be changed; or both can be changed.

For overhead or sidewall drilling, the fluid may also be employed as a means of seating the motor; as for example, where the motor is run into the rod at a pressure below that at which the valves 92 open, and then the pressure is raised to open the valves and commence drilling.

Where it is desired to drill for a period without coring, a plug-like bit can be substituted for the core barreling tube, and interengaged either with the pipe or with the annular bit, to rotate conjointly with the same.

I claim:

1. A down-the-hole motor which is adapted to be used to drive a rotary drill rod of the type comprising an elongated pipe having a longitudinally extending bore therethrough, a percussive bit at the distal end thereof, and an abutment thereon relatively transverse the bore adjacent the bit, said motor comprising a cylindrically outlined piston member which is adapted to be slidably engaged in the bore of the pipe and has a fluid operated hammer mechanism thereon for applying hammer blows to the rod through the abutment, an anvil member which is coaxially interconnected with the piston member at a position relatively forwardly of the hammer mechanism and has a diameter no greater than that of the piston member so that it can be inserted in the bore ahead of the piston member and engaged with the abutment to receive and transmit the hammer blows into the abutment, fluid transmission means for operating the hammer mechanism, means on the relatively rear end portion of the piston member for admitting fluid to the same from the bore of the pipe when the motor is engaged in the bore, means for discharging the fluid from the motor including means for passing fluid through the anvil member from the piston member, and means on the piston member for causing a pressure drop in the fluid as it discharges from the motor, whereby a pressure differential can be generated across the motor axially of the members when the motor is engaged with the abutment and transmitting hammer blows thereto.

2. The motor according to claim 1 wherein the anvil member is cylindrically outlined and has the same diameter as the piston member so that it is also adapted to be slidably engaged in the bore of the pipe.

3. The motor according to claim 1 wherein the piston member is adapted so that the fluid admitted to the relatively rear end portion of the piston member, operates the hammer mechanism and then exhausts from the mechanism through the anvil member.

4. The motor according to claim 1 wherein the rod is of a type in which the abutment opens into the working face of the bit, and the motor further comprises an excavation member which is coaxially interconnected with the anvil member and has a diameter less than that of the anvil member so that it is adapted to insert into the opening of the abutment when the anvil member is engaged with the abutment.

5. The motor according to claim 4 wherein the anvil and excavation members are relatively reciprocably interconnected with one another.

6. The motor according to claim 4 wherein the anvil and excavation members are relatively rotatably and reciprocably interconnected with one another.

7. The motor according to claim 4 wherein the anvil member has a fluid passage therein, and a port for discharging the fluid from the passage about the excavation member.

8. The motor according to claim 4 wherein the anvil and excavation members are detachably interconnected with one another.

9. The motor according to claim 4 wherein the excavation member takes the form of a core barrel.

10. The motor according to claim 1 wherein the piston and anvil members are relatively reciprocably interconnected with one another.

11. The motor according to claim 1 further comprising attachment means on the relatively rear end portion of the piston member for releasable engagement by a wire line retriever or the like.

12. In combination, a rotary drill rod comprising an elongated pipe having a longitudinally extending bore therethrough, a percussive bit at the distal end thereof, and an abutment thereon relatively transverse the bore adjacent the bit, and a down-the-hole motor for driving the rod, comprising a cylindrically outlined piston member which is slidably engaged in the bore of the pipe and has a fluid operated hammer mechanism thereon for applying hammer blows to the rod through the abutment, an anvil member which is coaxially interconnected with the piston member in the bore of the pipe, at a position relatively forwardly of the hammer mechanism, and engaged with the abutment to receive and transmit the hammer blows into the abutment, fluid transmission means for operating the hammer mechanism, means on the relatively rear end portion of the piston member for admitting fluid to the same from the bore of the pipe, means for discharging the fluid from the motor including means for passing fluid through the anvil member from the piston member, and means on the piston member for causing a pressure drop in the fluid as it discharges from the motor, whereby a pressure differential is generated across the motor axially of the members when the motor is transmitting hammer blows to the abutment.

13. The combination according to claim 12 wherein the anvil member is cylindrically outlined and also slidably engaged in the bore of the pipe.

14. The combination according to claim 12 wherein the piston member is adapted so that the fluid admitted to the relatively rear end portion of the piston member, operates the hammer mechanism and then exhausts from the mechanism through the anvil member.

15. The combination according to claim 12 wherein the abutment opens into the working face of the bit, and there is an excavation member coaxially interconnected with the anvil member, which is inserted into the opening of the abutment.

16. The combination according to claim 15 wherein the anvil member has a fluid passage therein, and a port for discharging the fluid from the passage about the excavation member.

17. In the process of drilling an earth formation using a rotary drill rod comprising an elongated pipe having a longitudinally extending bore therethrough, a percussive bit at the distal end thereof, and an abutment thereon relatively transverse the bore adjacent the bit, the steps of inserting an anvil member into the bore of the pipe and engaging the member with the abutment, inserting into the bore at a position relatively rearwardly of the anvil member, a cyclindrically outlined piston member which is slidably engageable with the bore and has a fluid operated hammer mechanism thereon, the hammer of which is relatively reciprocable between the anvil and piston members, applying blows to the anvil member with the hammer mechanism, to drive the rod, while rotating the drill rod and charging the bore with pressurized fluid relatively rearwardly of the piston member, admitting fluid to the piston member from the bore, discharging the fluid from the motor through the anvil member, and causing a pressure drop in the fluid as it discharges from the motor, to generate a pressure differential across the motor longitudinally of the bore.

18. The process according to claim 17 wherein the hammer mechanism is operated by the fluid admitted to the piston member, and the operating fluid is exhausted through the anvil member after the mechanism has operated.

* * * * *